United States Patent [19]

Livingston

[11] Patent Number: 4,526,455

[45] Date of Patent: Jul. 2, 1985

[54] METHOD OF AND SYSTEM FOR CONTROLLING EDGE OF DISTRIBUTED PROCESSING FLUID

[75] Inventor: James J. Livingston, Waltham, Mass.

[73] Assignee: Polaroid Corporation, Cambridge, Mass.

[21] Appl. No.: 529,211

[22] Filed: Sep. 6, 1983

[51] Int. Cl.[3] ..... G03D 9/00

[52] U.S. Cl. ..... 354/298; 354/303; 354/317; 118/665

[58] Field of Search ..... 354/88, 298, 317, 318, 354/324, 83, 84, 85, 86, 87, 301, 302, 303, 304, 305; 118/663, 665

[56] References Cited

U.S. PATENT DOCUMENTS

| | | | |
|---|---|---|---|
| 2,435,719 | 2/1948 | Land | 354/84 |
| 2,558,858 | 7/1951 | Land | 354/303 |
| 2,563,343 | 8/1951 | Land | 354/303 |
| 2,686,717 | 8/1954 | Land | 430/209 |
| 2,719,789 | 10/1955 | Land | 354/86 |
| 3,120,794 | 2/1964 | Gold | 354/301 |
| 3,307,467 | 3/1967 | Gold et al. | 354/303 |
| 3,625,129 | 12/1971 | Allen | 354/304 |
| 3,648,584 | 3/1972 | Eacock | 354/88 |
| 4,162,834 | 7/1979 | MacLean | 354/86 |
| 4,341,453 | 7/1982 | Rubin | 354/298 |
| 4,365,895 | 12/1982 | Shaber | 354/298 |

*Primary Examiner*—A. A. Mathews

*Attorney, Agent, or Firm*—Leslie J. Payne

[57] ABSTRACT

A method of and system for supplying processing material to a photographic sheet so as to control material supplied thereto are disclosed. Included in the method are the steps of supplying processing material to the photographic sheet; and detecting a reference area on the sheet. The detecting step includes transmitting at least a beam of measured energy to the reference area and generating a signal responsive to a change in a measured characteristic of the reflected beam from the area which signal is representative of material being present or absent in the area. The output of processing material supplied is varied to the sheet responsive to the generated signal so as to restore the reference area to its condition before the signal.

16 Claims, 3 Drawing Figures

METHOD OF AND SYSTEM FOR CONTROLLING EDGE OF DISTRIBUTED PROCESSING FLUID

BACKGROUND OF THE INVENTION

The present invention relates generally to a method of and apparatus for controlling the supply of fluid. More particularly, this invention relates to a method of and apparatus for controlling the edge of processing fluid distributed between a pair of converging sheets, just prior to the sheets becoming superposed to each other.

A variety of photographic processes of the self-developing type broadly involve the application of a viscous liquid reagent across exposed photographic sheet material. Typically, in these processes, a photosensitive sheet is first exposed and then later superposed with respect to a second sheet. The two superposed sheets are then moved between a pair of juxtaposed pressure applying members. The pressure applying members are constructed and arranged so as to spread the fluid from this mass, in an approximately uniform layer, over a desired exposed portion of one of the sheets. The spread processing fluid can initiate formation of visible images.

Significant problems can arise in connection with distributing the fluid in such a manner. One is to maintain a sufficient amount of fluid over the exposed areas of a sheet. This is for the obvious reason that it is critical for complete image formation that the amount of processing fluid be accurately and uniformly spread out over such exposed area. Secondly, it is also important to contain the processing fluid within the desired confines of the side marginal edges of the sheets. Otherwise, of course, processing fluid falling beyond such edges would contaminate the pressure applying rollers and other equipment associated with the processing of the photosensitive sheets. Variations in the amount of processing fluid distributed at any given time can arise in situations wherein the viscosity of the fluid changes. Thus, when attempting to dispense controlled amounts of such fluid, these variations can increase or decrease the amount dispensed. Thus, significant problems can arise in trying to keep the lateral edge of the fluid from spilling off the lateral edges of the sheet while insuring that the fluid covers the exposed area for complete developing. Such considerations are particularly crucial when it is desired to process large quantities of film and there is a relatively narrow space between the lateral margins and exposed areas of the sheets.

There have been a number of approaches for controlling the distribution of such processing fluid. One makes provision for having side rails on a film sheet which are capable of confining excess liquid within the side marginal edges. Another solution, disclosed in U.S. Pat. No. 3,120,794, describes one of the processing rollers having a pair of axially spaced apart sealing elements for purposes of confining the dispensed fluid within the side margins of the sheets. U.S. Pat. No. 3,307,467 discloses spring-biased pressure applying members which prevent escape of the liquid from between the lateral margins of the sheets as the sheets are advanced through a gap between the pressure applying members. U.S. Pat. No. 4,162,834 discloses a pair of laterally spaced nozzle members which direct streams of air at opposite ends of a longitudinal processing fluid puddle. U.S. Pat. No. 2,563,343 discloses an approach for controlling the supply of processing fluid within the marginal edges. In this approach, a liquid gauging system is provided which, in one mode, includes a pair of spaced electrical contacts. Each one is positioned adjacent a lateral marginal edge of a liquid holding space. The contacts are pressed against the edges of one of the two sheets being superposed. Normally, the contacts do not touch the processing fluid. However, when an excess amount of liquid exists within the holding space, it tends to contact both switches. As this happens, an electrical connection is created between the two contacts for causing operation of a solenoid so as to open a switch. The switch is then responsible for operating a valve which restricts the fluid dispensed. U.S. Pat. No. 2,719,789 discloses a similar process by which liquid is prevented from going beyond the lateral marginal edges of the processing sheets. Disclosed is the fact that one of the film sheets is provided with a succession of conducting strips along each lateral marginal edge. The strips cooperate with spaced apart brushes so as to form part of an electrical control circuit. When fluid covers both conducting strips, the circuit is operative to control a solenoid which, in turn, controls a valve for restricting fluid flow.

None of the foregoing approaches, however, disclose a system which can simply and conveniently control distribution of processing fluid to an area adjacent a marginal edge of a photographic sheet, let alone one which can reliably control the edges of fluid distributed within a preselected zone of the sheet wherein one edge of the zone is adjacent a marginal edge of the sheet and an opposite edge of the zone is adjacent a preselected portion of the sheet.

SUMMARY OF THE INVENTION

According to the present invention, there is provided an improved method of and apparatus for controlling the supply of processing fluid to a photographic sheet. Included in the method are the steps of supplying processing material to the photographic sheet and detecting a reference area on the sheet. In the detecting step at least a beam of measured energy is transmitted to the reference area and a signal is generated responsive to a change in a measured characteristic of the reflected beam from the area. This signal is representative of material being present or absent in the area. The method includes the step of varying the output of processing material supplied to the sheet responsive to the generated signal so as to restore the reference area to its condition before the signal.

In an illustrated embodiment of another method of distributing processing fluid to a photographic sheet, such method controls the edge of fluid distributed within a preselected zone on the sheet. One edge of the zone is adjacent a marginal edge of the sheet and an opposite edge of the zone is adjacent a preselected portion of the sheet. The method includes the step of distributing processing fluid to the photographic sheet so that the edge of the fluid is flowable to the zone. A reference area within the zone is detected by transmitting at least a beam of measured energy to the reference area and generating alternate first and second signals responsive to the material interrupting and not interrupting; respectively, the beam in the area. Alternately, the output of processing fluid being distributed to the sheet is increased and decreased in response to alternate ones of said first and second signals so that the edge of the fluid remains in the preselected zone.

The invention contemplates that the beam of energy is infrared energy and which is non-actinic relative to the photographic sheet.

The invention includes a system for supplying processing material to a photographic sheet so as to control material supplied. Included in the system is means for supplying processing material to the photographic sheet material and means for detecting a reference area on the sheet. The detecting means includes means for transmitting at least a beam of measured energy to the reference area and for generating a signal responsive to a change in a preselected measured characteristic of the reflected energy from the area which change is representative of material being present or absent in the area. Responsive to the signal is means for varying the output of the processing fluid supplied to the sheet so as to restore the reference area to its condition before the change therein by the fluid which caused the change in the measured characteristic of the reflected energy.

Among the objects of the invention are, therefore, the provision of an improved method and system for controlling the supply of processing material to a photographic sheet; the provision of an improved method of and apparatus for controlling processing fluid along a marginal edge of the sheet; the provision of an improved method of and apparatus for automatically controlling the edge of processing fluid wihtin a zone on the sheet wherein one edge of the zone is a lateral marginal edge of the sheet and another edge of the zone is adjacent a photographically exposed zone of the sheet; the provision of an improved method of and apparatus of the above type in which a change in the measured characteristics of a reflected beam of energy is indicative of the presence or absence of fluid in a reference area in said zone; the method and apparatus of the above type which uses energy which is non-actinic to the sheet; and, the method and apparatus of the above type in which a single beam of energy controls the edge of fluid adjacent both lateral margins of the sheet.

Other objects and further scope of applicability of the present invention will become apparent from the detailed description to follow when taken in conjunction with the accompanying drawings wherein like parts are indicated by like reference numerals throughout the several views.

DETAILED DESCRIPTION

Figure 1:
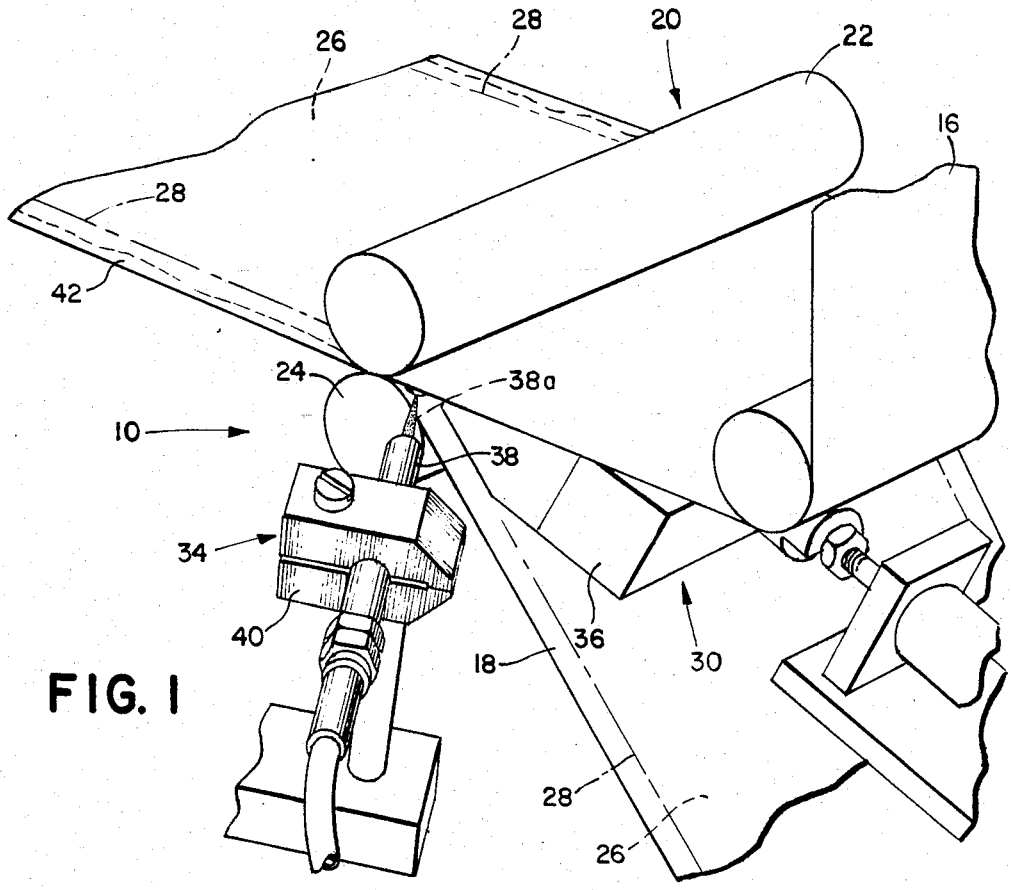
FIG. 1 is a perspective view showing a component of the fluid control system of the present invention controlling the edge of fluid distributed between a pair of converging film sheets.
Figure 2:
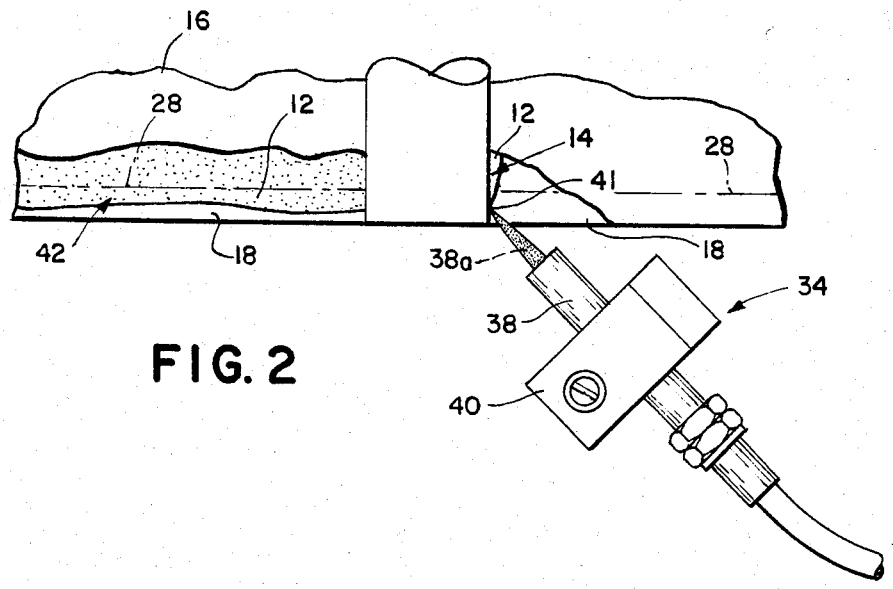
FIG. 2 is an enlarged and fragmented plan view showing in greater detail certain features of the present invention; and, FIG. 3 is a block diagram showing the fluid control system of the present invention.
Figure 3:
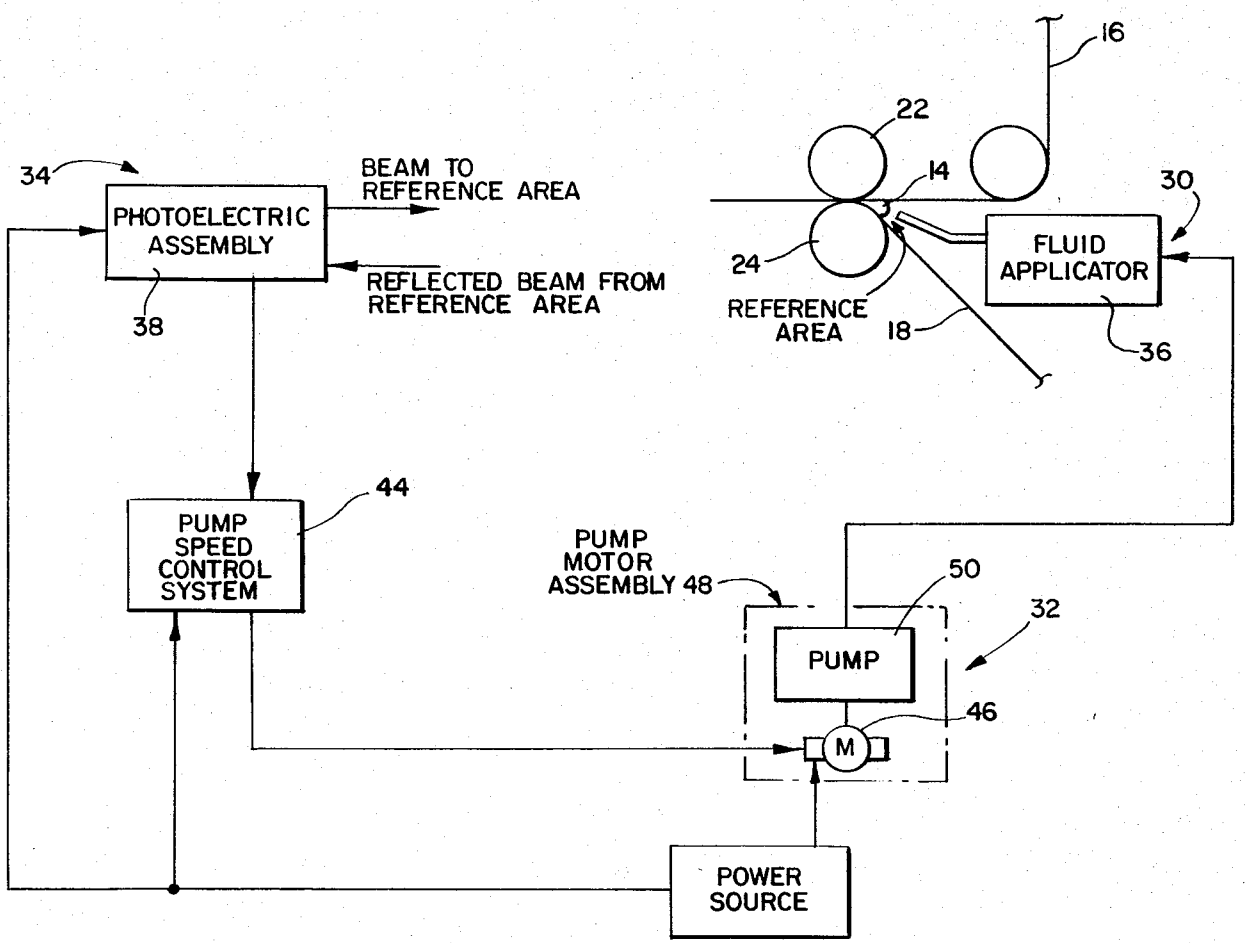

Reference is now made to FIGS. 1–3 for showing a processing fluid control system 10 which selectively distributes processing fluid 12 in the form of a puddle 14 to and between a pair of converging photographic type image-receiving and image-forming sheets 16 and 18, respectively. The sheets 16, 18 are drawn along converging paths by a conventional type of processing assembly, indicated generally by reference numeral 20. Only the pair of pressure applying rollers 22 and 24 are shown. The processing assembly 20 does not form an aspect of the present invention, thus a detailed description thereof has been dispensed with. Only those portions of the processing assembly 20 necessary for an understanding of the present invention will be described.

In this embodiment the photosensitive negative image-forming sheet 18 is of the type having a plurality of layers including a photosensitive layer, which has been photographically exposed previously in a camera, and which, of course, carries the latent images thereon. The positive or image-receiving sheet 16 is made of a flexible sheet material which is capable of supporting thereon a positive transfer print. To effect such a transfer from the negative to the positive the processing fluid 12 is spread between the sheets 16, 18 and the sheets are kept superposed for at least a preselected imbibition period. The processing fluid 12 is a relatively viscous and easily oxidizable material. Spreading of the processing fluid 12 into a uniform layer is achieved by the pair of pressure applying rollers 20, 22 which have a predetermined gap set forth therebetween. As noted, the pressure applying rollers 20 and 22 facilitate not only superimposing of sheets 16, 18 but spreading of such fluid. It should be pointed out that subsequent to imbibition, the sheets 16 and 18 are stripped by means not shown and not forming part of the present invention. Although the present embodiment has disclosed that the visible images will be formed on the positive sheet 16, it is also contemplated by the present invention that the visible images may be formed in the negative sheet 18. In this regard, the sheet 16 would serve to spread the processing fluid thereon.

The fluid control system 10 is arranged to insure that the processing fluid 12, which is of a type used in the instant photographic field, does not extend beyond the lateral marginal edges of the sheets as well as covers the exposed areas 26 on the sheet 18, between the exposed margins 28, being transferred.

Essentially, the fluid control system 10 comprises a fluid distribution unit 30, a fluid supply arrangement 32, and a fluid monitoring assembly 34.

Included in the fluid distribution unit 30 is a fluid applicator 36 which is arranged adjacent an area at which the sheets 16, 18 become superposed so as to dispense a metered amount of pumped processing fluid thereto in the form of a puddle 14. A variety of fluid applicators can be used for the purposes noted.

Referring to the fluid monitoring assembly 34, it includes a photoelectric assembly or apparatus 38. The photoelectric apparatus 38 is mounted by a clamp assembly 40 so that the apparatus can transmit a continuous focused beam 38*a* of electromagnetic radiation at a reference area 41 in a zone 42 which is between the lateral margins of the sheets and the margins 28 of the exposed area 26. The photoelectric apparatus 38 is of the type which includes an emitter and a detector, both of which are not shown. The emitter transmits measured electromagnetic energy to the reference area 41 and the detector measures a characteristic of the transmitted beam reflected from the area. When the transmitted beam 38*a* is interrupted by the presence of fluid 12 in the area 41, the measured characteristic of the reflected beam changes, which effects a generated signal representative of such changed condition. This signal is representative of the fact that the processing fluid 12 is in the reference area 41 and thus, too much processing fluid is in the puddle 14. As a consequence, there is a probability that the fluid 12 will flow off the sheet 18 and onto the pressure applying rollers and the like.

The generated signal is transmitted to a known type of pump speed control system 44. The pump speed control system 44 is responsive to such signal for decrementing the speed of the motor 46 of the pump/motor assembly 48 by a predetermined amount. By selectively decrementing the motor speed, the amount of processing fluid pumped by the pump 50 is accordingly decremented. The pump 50, in this embodiment, is a constant displacement type. Thus variations in viscosity will change the output. The decrease in the pumped amount will restore the reference area 41 to the condition it was in prior to the fluid interrupting the beam. When this condition occurs, the beam is no longer interrupted. This condition creates a signal which is transmitted to the pump speed control system 44. This latter signal is responsible for having the system 44 increment the motor speed. By incrementing the motor speed, by a predetermined amount, the pump 50 correspondingly increments the output of fluid pumped. This will cause the edge of the puddle 14 to again extend towards the sheet's lateral edges until the fluid again interrupts the beam 38*a*. Accordingly, the control system 10 cyclically alternates between increasing and decreasing the amount of fluid distributed so that the edges thereof stay within the noted zone 42.

In this embodiment, the photoelectric apparatus 38 transmits a beam of infrared radiation at the reference area. Use of infrared energy is advantageous insofar as it is non-actinic to the photosensitive sheets. Other forms of preferably non-actinic radiation can be used such as ultraviolet frequencies. Also, the present invention contemplates use of acoustic energy instead of the electromagnetic energy for monitoring purposes. Although the present embodiment describes a system which is arranged to keep the fluid from the marginal edges, it also contemplates a system wherein it is desired to have the fluid extend to the marginal edge. In such a system, the characteristics of the reflected beam of the photoelectric apparatus 38 would be changed by the absence of fluid in the reference area 41. The present invention also contemplates that instead of relying upon the characteristics of reflected energy to be indicative of fluid being present or absent, other sources of electromagnetic radiation as X-rays and gamma rays could be used. In such an arrangement, a detector would monitor a source of such energy for changes. The detector would be positioned so as to not interfere with processing operation.

From the foregoing detailed description, it is believed the operation of the apparatus and the performance of method of the present invention are evident.

Since certain changes may be made in the above-described method and apparatus without departing from the scope of the invention herein involved, it is intended that all matter contained in the description or shown in the accompanying drawings shall be interpreted as illustrative and not in a limiting sense.

What is claimed is:

1. A method of supplying processing material to a photographic sheet so as to control material supplied thereto, comprising the steps of:

supplying processing material to the photographic sheet;

detecting a reference area on the sheet, said detecting step including transmitting at least a beam of measured energy to the reference area and generating a signal responsive to a change in a measured characteristic of the beam from the area which signal is representative of material being present or absent in the area; and, varying the output of processing material supplied to the sheet responsive to the generated signal so as to restore the reference area to its condition before the signal.

2. A method of distributing processing fluid to a photographic sheet so as to control the edge of fluid distributed within a preselected zone of the sheet, wherein one edge of the zone is adjacent a marginal edge of the sheet and an opposite edge of the zone is adjacent a preselected portion of the sheet comprising the steps of:

distributing processing fluid to the photographic sheet so that the edge of the fluid is flowable to the zone;

detecting a reference area within the zone, said detecting step including transmitting at least a beam of measured energy to the reference area and generating alternate first and second signals responsive to the material interrupting and not interrupting; respectively, the beam in the area; and, alternately decreasing and increasing the output of processing fluid being distributed to the sheet in response to alternate ones of said first and second signals to that the edge of the fluid remains in the preselected zone.

3. The method of claim 2 wherein said detecting step includes transmitting a beam of energy which does not react with the photographic sheet.

4. The method of claim 3 wherein the beam of energy is infrared energy which is non-actinic relative to the photographic sheet.

5. A system for supplying processing material to a photographic sheet so as to control material supplied thereto comprising the steps of:

means for supplying processing material to the photographic sheet material;

means for detecting a reference area on the sheet, said detecting means includes means for transmitting at least a beam of measured energy to the reference area and for generating a signal responsive to a change in a preselected measured characteristic of the reflected energy from the area which change is representative of material being present or absent in the area; and, means responsive to said signal for varying the output of the processing fluid supplied to the sheet so as to restore the reference area to its condition before said change therein by the fluid which caused the change in the measured characteristic of the reflected energy.

6. The system of claim 5 wherein said means for transmitting the energy transmits energy which is non-actinic to the photographic sheet.

7. The system of claim 6 wherein said means for transmitting the energy to the reference area and for generating a signal responsive to the reflected energy from the area is an optical detector apparatus, said optical detector apparatus transmits a beam of radiation, which is non-actinic to the photographic sheet, and which detects a reflected component of the beam such that when said beam is interrupted by fluid there is a change in a measured characteristic of the reflected beam.

8. The system of claim 5 wherein said responsive means includes a pump which is operable to vary the output of fluid therefrom and a control apparatus which is operably connected to the pump and which is responsive to said signal so as to vary the output.

9. A system of distributing processing fluid to the photographic sheet so as to control the edge of fluid distributed within a preselected zone of the sheet wherein one edge of the zone is adjacent a marginal edge of the sheet and an opposite edge of the zone is adjacent a preselected portion of the sheet comprising:

means for distributing processing fluid to the photographic sheet so that the edge of the fluid is flowable to the zone;

means for detecting a reference area within the zone, said detecting means including means for transmitting at least a beam of measured energy to the reference area and generating alternate first and second signals responsive to the fluid interrupting and not interrupting the beam in the area; respectively; and, means alternately responsive to said first and second signals for alternately decreasing and increasing the output of processing fluid being distributed to the sheet; respectively, so that the edge of the fluid remains in the preselected zone.

10. A method of coating a given width of a moving strip of photographic material with a fluid while maintaining the lateral margins of said strip free of said fluid, said method comprising the steps of:

dispensing fluid at a select rate to an area of said strip narrower than the desired coating width as the strip is advanced past a given location;

detecting the lateral spread of said dispensed fluid to a predetermined margin limit of said desired coating width; and, reducing said dispensing rate responsive to detection of said fluid at said limit and increasing said dispensing rate responsive to a lack of detection of said fluid at said limit whereby said fluid dispensing rate is automatically increased and decreased to maintain a coating width terminating on or close to said margin limit.

11. The method of claim 10 wherein said detecting step includes directing a beam of radiation to said moving sheet in the area of said margin limit following dispensing of said fluid, and evaluating the change in radiation due to impingement on said fluid so as to detect the presence or absence thereof at said margin limit.

12. The method of claim 11 wherein said evaluating step includes evaluating the reflection of said beam from its impingement in said moving sheet.

13. The method of claim 11 wherein said reducing and increasing step includes decrementing said dispensing rate by a fixed amount upon detection of the presence of said fluid at said margin limit and incrementing said dispensing rate by said fixed amount upon detection of the absence of said fluid at said margin limit.

14. Apparatus for coating a given width of a moving strip of photographic material with a fluid while maintaining lateral margins free of said fluid, said apparatus comprising:

means for dispensing fluid at a selected rate to an area of said strip narrower than the desired coating width as the strip is advanced therepast;

means for detecting the lateral spread of said dispensed fluid to a predetermined margin limit and for producing a signal responsive to said spread of said fluid to said margin limit; and, control means responsive to the production of said signal for decreasing said dispensing rate and responsive to the termination of said signal for increasing said dispensing rate whereby said fluid dispensing rate is automatically increased and decreased to maintain a coating width terminating close to said margin limit.

15. The apparatus of claim 14 wherein said detecting and signal producing means includes means for directing a beam of radiation to said moving sheet in the area of said margin limit following dispensing of said fluid, for evaluating the change in radiation responsive to impingement of said beam on said fluid, and for producing a signal indicative of one condition of either the presence or absence of fluid in said area.

16. The apparatus of claim 15 wherein said control means includes means for decrementing said dispensing rate by a fixed amount responsive to production of said signal and for increasing said dispensing rate by a fixed amount responsive to termination of said signal.

* * * * *